US008350172B2

(12) United States Patent
Tsai et al.

(10) Patent No.: US 8,350,172 B2
(45) Date of Patent: Jan. 8, 2013

(54) ILLUMINATED KEYBOARD

(75) Inventors: Ching Cheng Tsai, Taipei Hsien (TW); Wen Ching Chiang, Taipei Hsien (TW)

(73) Assignee: Chicony Electronics Co., Ltd., Taipei Hsien (TW)

( * ) Notice: Subject to any disclaimer, the term of this patent is extended or adjusted under 35 U.S.C. 154(b) by 254 days.

(21) Appl. No.: 12/662,207

(22) Filed: Apr. 6, 2010

(65) Prior Publication Data

US 2010/0258420 A1 Oct. 14, 2010

(30) Foreign Application Priority Data

Apr. 8, 2009 (TW) ..... 98111681 A

(51) Int. Cl.
*H01H 9/00* (2006.01)

(52) U.S. Cl. ..... 200/314

(58) Field of Classification Search ..... 200/310–314, 200/317, 512–520, 5 A, 5 R, 341, 237, 344
See application file for complete search history.

(56) References Cited

U.S. PATENT DOCUMENTS 6,860,612 B2 * 3/2005 Chiang et al. ..... 362/29
7,057,125 B1 * 6/2006 Tsai ..... 200/310
7,525,056 B2 * 4/2009 Chiba et al. ..... 200/314
7,628,500 B2 * 12/2009 Chou ..... 362/30

* cited by examiner

*Primary Examiner* — Edwin A. Leon
(74) *Attorney, Agent, or Firm* — Bacon & Thomas, PLLC

(57) ABSTRACT

Presented herein is an illuminated keyboard having: a key module having a plurality of keycaps, scissors structures, elastic members, and a membrane circuit board; a keyboard base plate having a plurality of positioning members corresponding to the keycaps and integrally formed on the keyboard base plate for positioning the keyboard module on the keyboard base plate; a light guiding plate disposed beneath the key module and over the keyboard base plate, the light guiding plate having a light incoming surface, a bottom surface intersecting the light incoming surface, a light outgoing surface opposite to the light incoming surface, and provided with light holes corresponding to the positioning members; light sources arranged on one side of the light incoming surface of the light guiding plate, wherein a light emitted from the light sources is transmitted into the light guiding plate from the light incoming surface and transmitted out of the light guiding plate from the outgoing surface; and a reflecting sheet disposed beneath the bottom surface of the light guiding plate for reflecting the light emitted from the light sources into the light guiding plate, the reflecting sheet having through holes corresponding to the positioning members and the light holes.

17 Claims, 6 Drawing Sheets

ILLUMINATED KEYBOARD

CROSS-REFERENCE TO RELATED APPLICATIONS

This application claims priority to Taiwan Patent Application No. 98111681, filed on Apr. 8, 2009, which is incorporated herein by reference in its entirety.

BACKGROUND OF THE INVENTION

1. Field of the Invention

The present invention relates to an illuminated keyboard, and in particular to an illuminated keyboard having a light guiding plate.

2. Description of Related Art

There has been a trend toward equipping computers with illuminated keyboards in recent years. We can type easily in a lower light or dark environment because the light guiding plate (LGP) and light source technology has been increasingly employed in computer keyboards.

A conventional illuminated keyboard typically comprises a key switch, a backlight device, a seat, and a light guiding plate. Some conventional illuminated keyboards have complicated structures, such as multi-layer light guiding structure comprising a plurality of LGPs. For example, U.S. Pat. No. 6,860,612 contemplates an illuminated keyboard having an LGP and a light source located on the bottom of the keyboard. The light from the light source has to be transmitted through many layers to reach the keycaps at the top. As a result, manufacture of the illuminated keyboard with such a structure is complicated, and the light emitting capability and efficiency of the illuminated keyboard is limited. Also, please refer to FIG. 1 showing a cross-sectional schematic view of U.S. Pat. No. 6,284,988, the illuminated keyboard of which uses a single Electroluminescent(EL) sheet. The conventional illuminated keyboard, as shown in FIG. 1, roughly comprises a keyboard portion 21, a backlight device 25. The keyboard portion 21 includes a seat 23 and a membrane circuit board 24. The membrane circuit board 24 is provided with an elastic member 26, keycaps 22, and scissors structures 27. As shown in FIG. 1, the illuminated keyboard which employs EL as a backlight device 25 has a reduced the whole thickness of the keyboard. However, using EL as a backlight device has many disadvantages, such as a larger starting voltage, a short life time, complicated circuit designs, decreasing brightness, EMI caused to the membrane circuit board of the keyboard.

To address the aforementioned problems as well as provide various advantages, the present invention is directed to an illuminated keyboard.

SUMMARY OF THE INVENTION

Accordingly, an object of the present invention is to provide an illuminated keyboard which gives better light emitting capability and efficiency.

Another object of the present is to provide an illuminated keyboard giving that is thin in profile, lightweight, and low in cost.

To achieve these and other objects and advantages, an illuminated keyboard according to the present invention comprises: a key module having a plurality of keycaps, scissors structures, elastic members, and a membrane circuit board; a keyboard base plate having a plurality of positioning members corresponding to the keycaps and integrally formed on the keyboard base plate for positioning the keyboard module on the keyboard base plate; a light guiding plate disposed beneath the key module and over the keyboard base plate, the light guiding plate having a light incoming surface, a bottom surface intersecting the light incoming surface, a light outgoing surface opposite to the light incoming surface, and provided with light holes corresponding to the positioning members; light sources arranged on one side of the light incoming surface of the light guiding surface, wherein a light emitted from the light sources is transmitted into the light guiding plate from the light incoming surface and transmitted out of the light guiding plate from the outgoing surface; and a reflecting sheet disposed beneath the bottom surface of the light guiding plate and reflecting the light emitted from the light sources into the light guiding plate, the reflecting sheet having through holes corresponding to the positioning members and the light holes. The light holes are larger than the through holes. The light transmitted into the light guiding plate effectively illuminates the keyboard module through the light holes. Each of the light hole satisfies the condition $10° \leqq \theta_A \leqq 170°$, and it is more preferable for each of the light holes to satisfy the condition $45° \leqq \theta_A \leqq 90°$, where $\theta_A$ is an angle between a side wall inside each of the light holes and the bottom surface of the light guiding surface.

Preferably, in the illuminated keyboard, the bottom surface of the light guiding plate is provided with a plurality of light condensing patterns for condensing the light emitted from the light source by reflecting and refracting.

Preferably, in the illuminated keyboard, the light condensing patterns are formed by printing, laminating or sandblasting particles to the bottom surface.

Preferably, in the illuminated keyboard, the light guiding plate has at a least a side wrapped with reflective material for reflecting the light transmitted out of the light guiding plate, the at leas a side is different from the light incoming surface.

Preferably, in the illuminated keyboard, the light guiding plate is formed by plastic injection molding.

Preferably, in the illuminated keyboard, the reflecting sheet is made of white glossy material.

Preferably, in the illuminated keyboard, each of the light sources can be disposed under the bottom surface of the light guiding plate at a certain distance from the center of the light guiding plate.

Preferably, in the illuminated keyboard, the keyboard base plate can be metal mirror surface.

Preferably, in the illuminated keyboard, the membrane circuit board includes an elastic soft layer and a circuit layer.

Preferably, in the illuminated keyboard, the membrane circuit board includes a plurality of openings which are corresponding to the positioning members, and allow the light transmitted via the openings toward the keycaps.

Preferably, in the illuminated keyboard, the positioning members pass through the through holes, the light holes, and the openings of the membrane circuit board so as to connect the reflecting sheet, the light guiding plate and the membrane circuit board.

Preferably, in the illuminated keyboard, each of the scissors structures is provided between its respective corresponding keycap and respective elastic member, each of the elastic members is provided on the membrane circuit board, each of the scissors structures allows the corresponding keycap to move upward and downward relative to the keyboard base plate, each of the elastic members triggers the membrane circuit board to generate an electric signal when the keycap is pressed.

Preferably, in the illuminated keyboard, the circuit layer of the membrane circuit board is made of transparent material.

Preferably, in the illuminated keyboard, the circuit layer of the membrane circuit board can be formed on the top surface of the light guiding plate by printing.

Preferably, in the illuminated keyboard, the light sources are LEDs.

Preferably, in the illuminated keyboard, the light condensing pattern can be formed on the top surface of the light guiding plate.

Other objects, advantages, and novel features of the present invention will become more apparent from the following detailed description when taken in conjunction with the accompanying drawings.

DETAILED DESCRIPTION OF THE INVENTION

Figure 1:
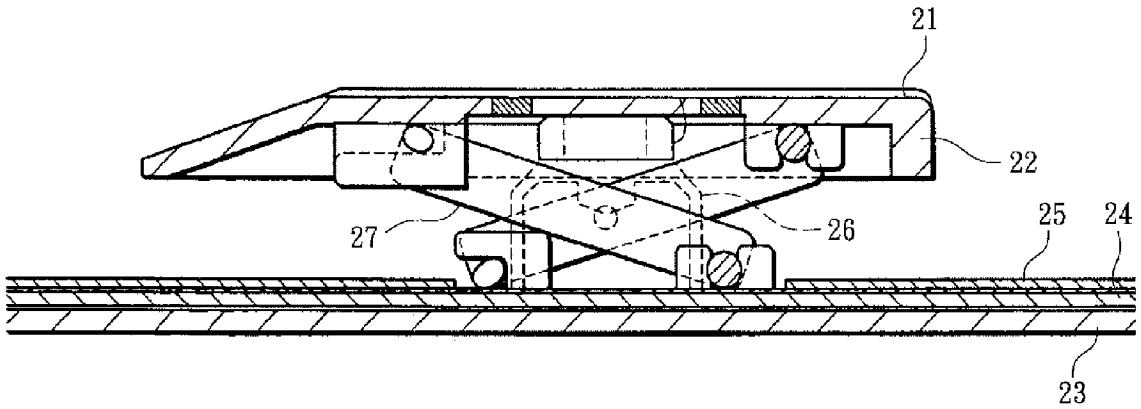
Fig. 1 Prior Art
FIG. 1 is a cross-sectional schematic view of a conventional illuminated keyboard.

In the following description, like parts are marked with the same reference numerals throughout the specification and drawings.

Figure 2:
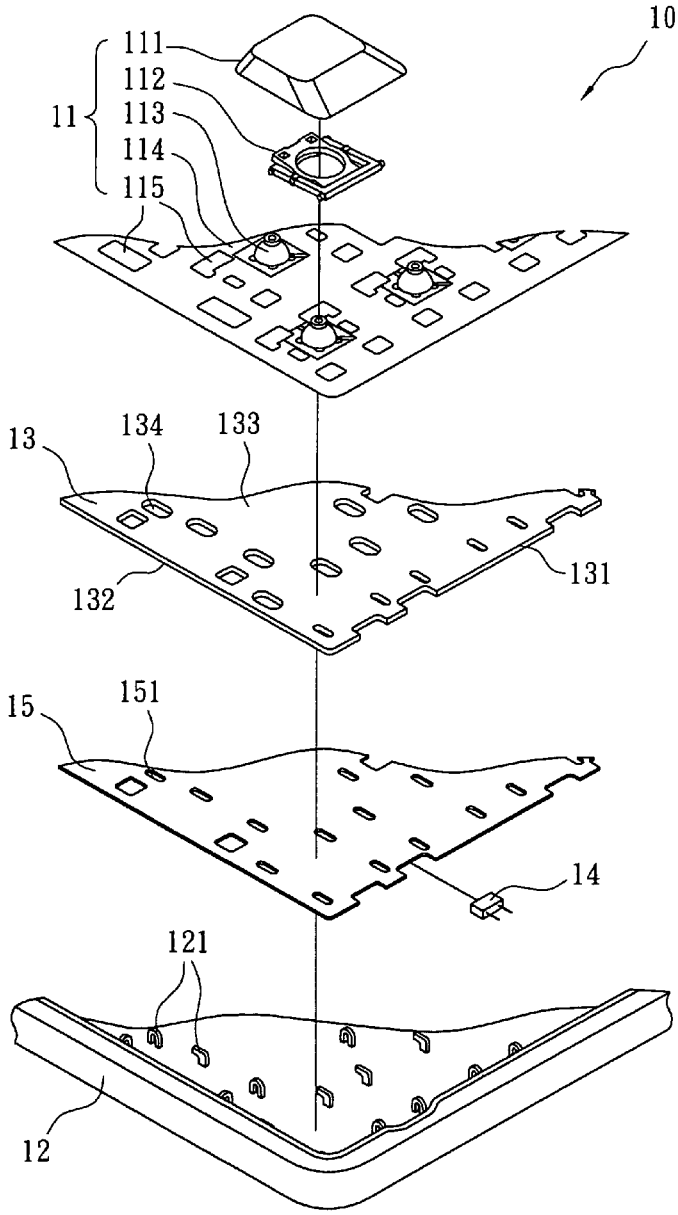
FIG. 2 is an exploded view of an illuminated keyboard of an embodiment according to the present invention.

FIG. 2 is an exploded view of an illuminated keyboard 10 of an embodiment according to the present invention. The illuminated keyboard 10 comprises a key module 11, a keyboard base plate 12, a light guiding plate 13, light sources 14, and a reflecting sheet 15.The key module 11 has a plurality of keycaps 111, scissors structures 112, elastic members 113, and a membrane circuit board 114. The keyboard base plate 12 has a plurality of positioning members 121 corresponding to the keycaps 111 and integrally formed on the keyboard base plate 12 for positioning the keyboard module 11 on the keyboard base plate 12. The light guiding plate 13 is disposed beneath the key module 11 and over the keyboard base plate 12. The light guiding plate 13 has a light incoming surface 131, a bottom surface 132 which intersects the light incoming surface 131, a light outgoing surface 133 opposite to the light incoming surface 131, and light holes 134 which corresponds to the positioning members 121. The light sources 14 which consists of a plurality of LEDs, for example, are arranged on one side of the light incoming surface 131 of the light guiding plate 13. A light emitted from the light sources 14 is transmitted into the light guiding plate 13 from the light incoming surface 131 and transmitted out of the light guiding plate 13 from the outgoing surface 133. Referring to FIG. 2, the reflecting sheet 15 is disposed beneath the bottom surface 132 of the light guiding plate 13 for reflecting the light emitted from the light sources 14 into the light guiding plate 13. The reflecting sheet 15 has through holes corresponding to the positioning members 121 and the light holes 134.

The light holes 134 are larger than the through holes 151. Through the light holes 134, the light transmitted into the light guiding plate 13 effectively illuminates the keyboard module 11 disposed over the light guiding plate 13.

Figure 3:
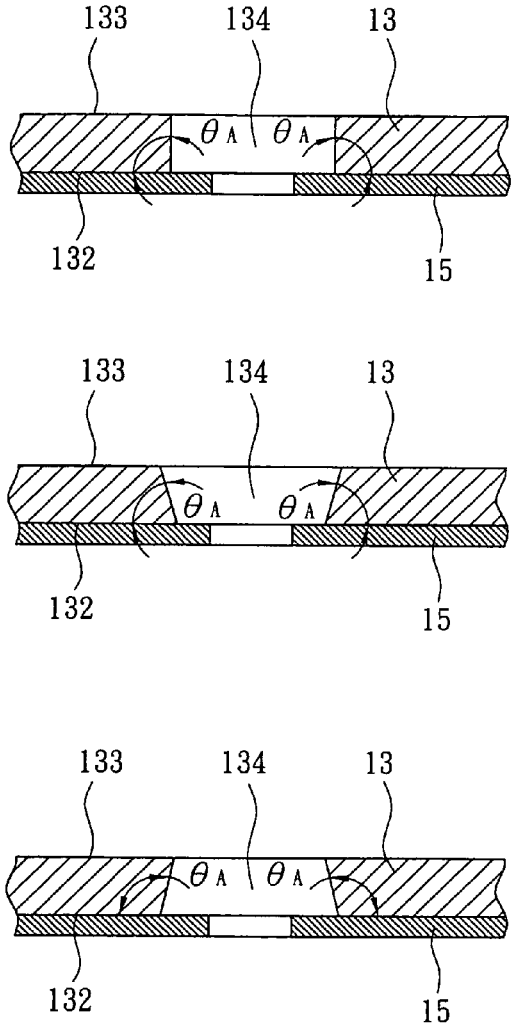
FIG. 3 is a cross-sectional schematic view of the light guiding plate of the illuminated keyboard of FIG. 2.

FIG. 3 is a cross-sectional schematic view of a light guiding plate 13 of the illuminated keyboard of FIG. 2. As shown in FIG. 3, each of the light holes 134 satisfies the condition $10° \leqq \theta_A \leqq 170°$, and it is more preferable for each of the light holes 134 to satisfy the condition $45° \leqq \theta_A \leqq 90°$, where $\theta_A$ is an angle between a side wall inside each of the light holes 134 and the bottom surface 132 of the light guiding plate 13. According to an embodiment of the present invention, the light guiding plate 13 is formed by plastic injection molding. Accordingly, this manufacturing process is simple and cost-effective.

Figure 4:
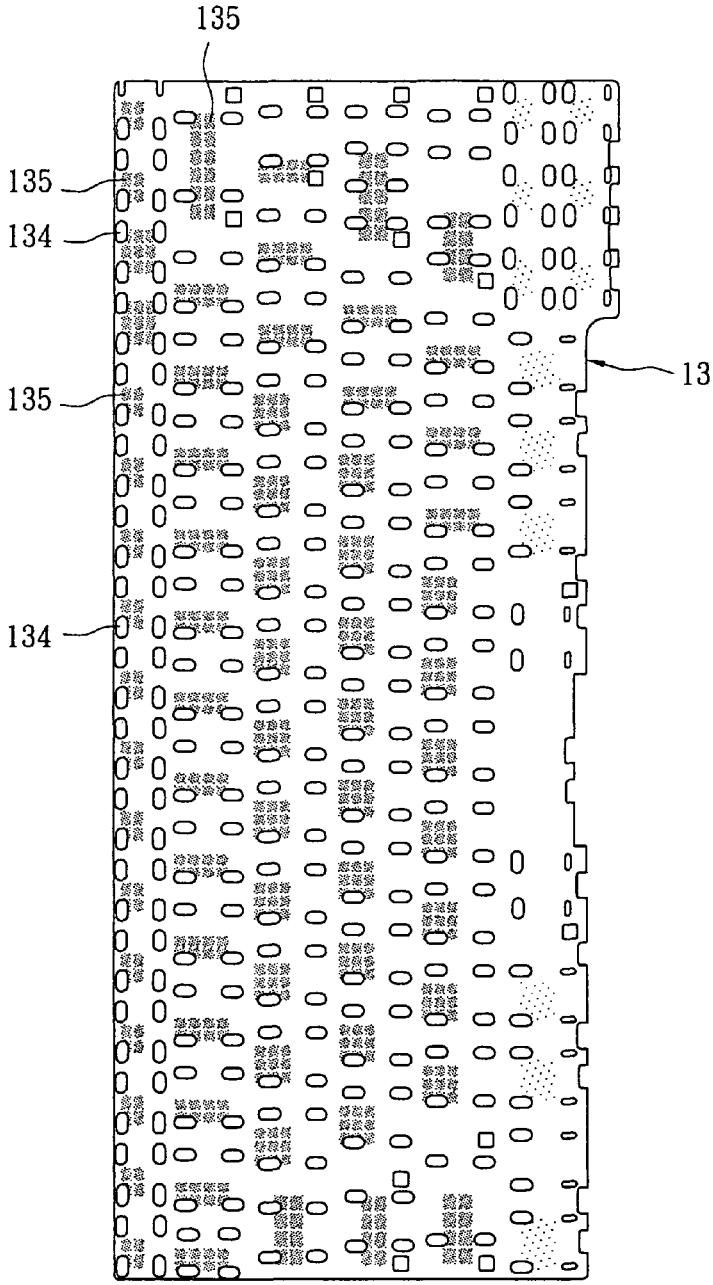
FIG. 4 is a top view of the light guiding plate of the illuminated keyboard of FIG. 2.

FIG. 4 is a top view of the light guiding plate 13 of the illuminated keyboard 10 of FIG. 2. Micro particles can be formed on the bottom surface 132 of the light guiding plate 13 by printing, laminating or sandblasting to form a plurality of light condensing patterns 135 on the bottom surface 132. The light condensing patterns 135 condense the light emitted from the light source 14 by means of reflecting and refracting. Also, the light condensing patterns 135 can be formed on a top surface of the light guiding plate 13 which is opposite to the bottom surface 132.

Light travels in all directions from its source. Accordingly, light transmitted into the light guiding plate will be transmitted through other surfaces in addition to the light outgoing surface. Therefore, at a least a side of the light guiding plate 13 which is different from the light incoming surface can be wrapped with reflective material for reflecting the light transmitted out of the light guiding plate 13. In this manner, the light from the light source can be effectively utilized.

Figure 5:
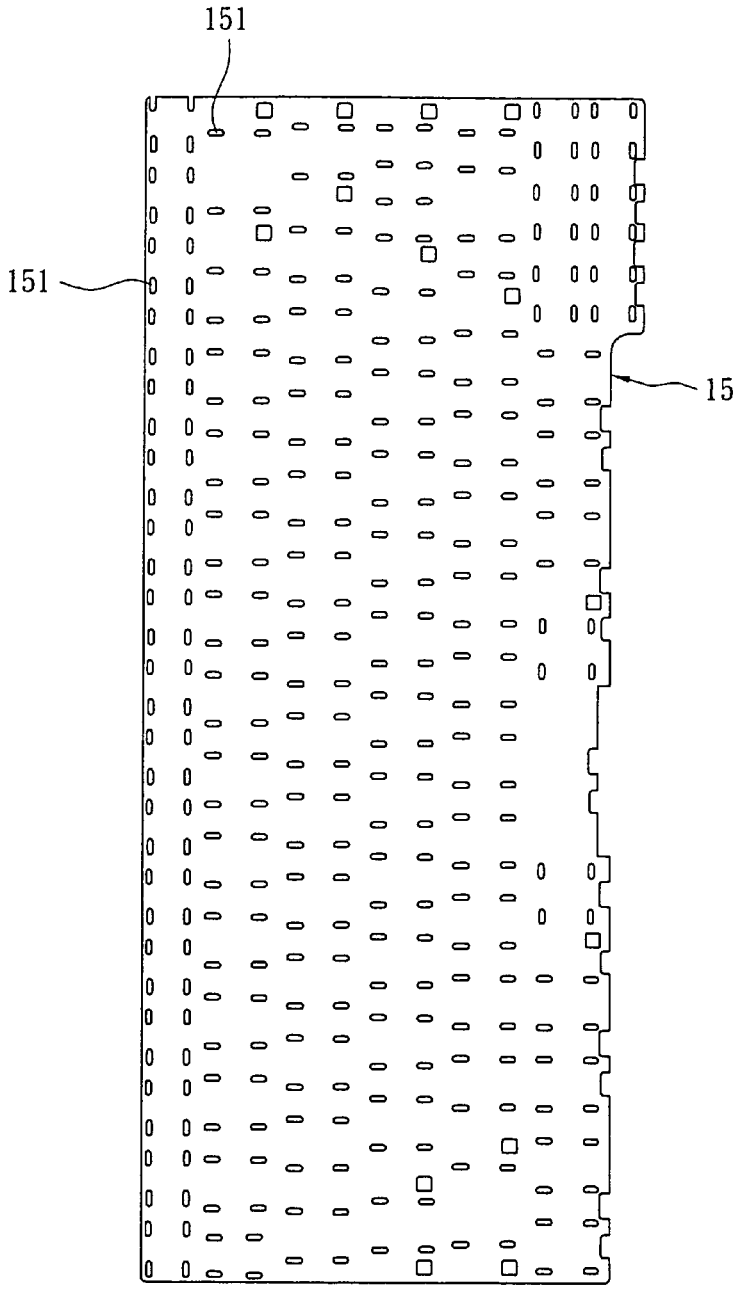
FIG. 5 is a top view of the reflecting sheet of the illuminated keyboard of FIG. 2.

FIG. 5 is a top view of the reflecting sheet 15 of the illuminated keyboard 10 of FIG. 2. According to an embodiment of the present invention, the reflecting sheet 15 can be reflective white plastic/PVC glossy sheet. In another embodiment, the reflective glossy sheet may be in different colors (such as green, blue, etc.) In another embodiment, the reflective sheet may be directly attached to the bottom surface 132 of the light guiding plate 13 which is adjacent to the keyboard base plate 12. In this manner, a layer of reflective sheet is omitted, resulting in an illuminated keyboard with a reduced thickness.

Figure 6:
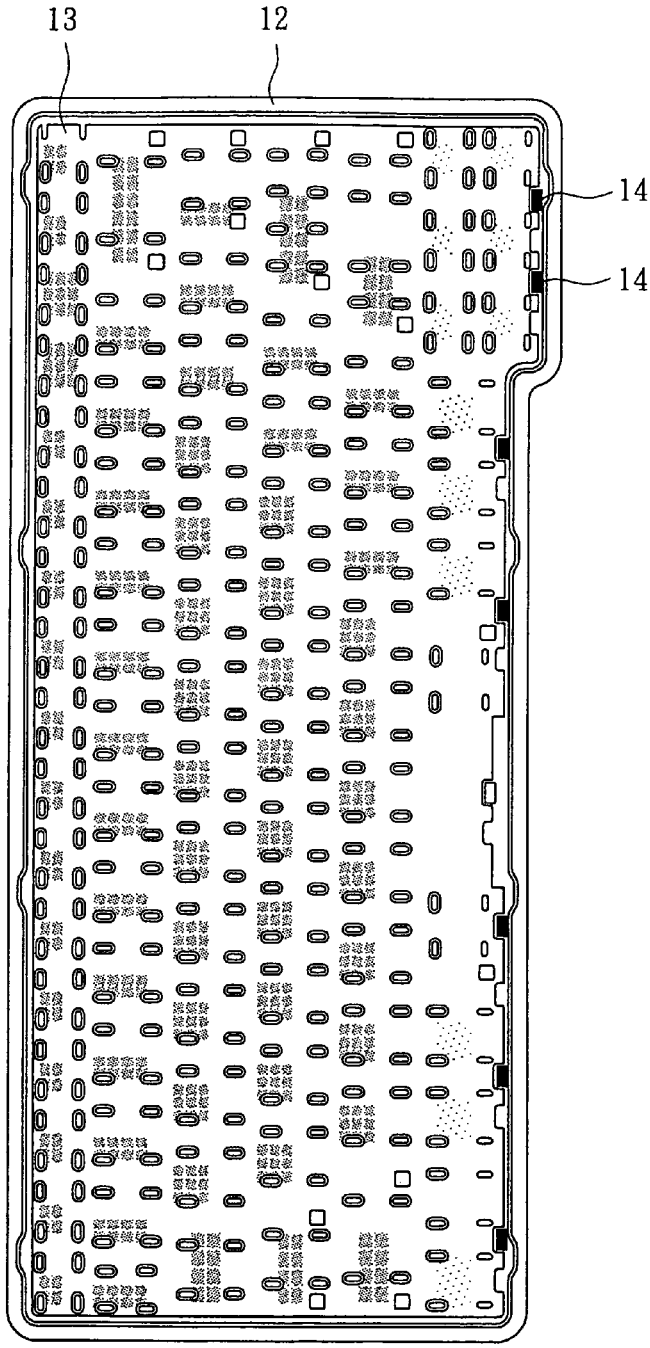
FIG. 6 is atop view of an assembly of the light guiding plate, the reflecting sheet, and the keyboard base plate of the illuminated keyboard of FIG. 2.

In addition to the arrangement of the light sources 14 consisting of LEDs, as shown in FIG. 6, in which the LEDs are arranged on one side of the light incoming surface 131, the LEDs can be disposed under the bottom surface 132 of the light guiding plate 13 at a certain distance from the light guiding plate 13. Moreover, aside from efficiency, low heat, longevity, the benefits of using LEDs as light sources include that LEDs provide a variety of arrangements and creates a variety of effects and a myriad of colors.

Referring back to FIG. 2, the membrane circuit board 114 includes an elastic soft layer (not shown) and a circuit layer (not shown). Further, the membrane circuit board 114 includes openings 115 corresponding to the positioning members 121, therefore the light can be transmitted via the openings 115 toward the keycaps 111. In specific, referring to FIG. 6, showing a top view of an assembly of the light guiding plate 13, the reflecting sheet 15, and the keyboard base plate 12 of the illuminated keyboard of FIG. 2. The positioning members 121 pass through the through holes 151 of the reflecting sheet 15, the light holes 134 of the light guiding plate 13, and the openings 115 of the membrane circuit board 114 so as to connect the reflecting sheet 15, the light guiding plate 13, and the membrane circuit board 114. According to an embodiment of the present invention, the keyboard base plate 12 can be a metal mirror surface which is favorable for reflecting light.

Referring now back to FIG. 2, scissors structures 112 are conventional. Each of the scissors structures 112 is provided between its respective corresponding keycap 111 and respective elastic member 113. Each of the elastic members 113 is provided on the membrane circuit board 114. Each of the scissors structures 112 allow its corresponding keycap 111 to move upward and downward relative to the keyboard base plate 12. Each of the elastic members 113 causes the membrane circuit board 114 to generate an electric signal when the keycap is pressed.

The circuit layer of the membrane circuit board 114 is made of transparent material. The circuit layer of the membrane circuit board 114 can be formed on the top surface of the light guiding plate 13 by printing.

It should be understood by those skilled in the art that various modifications, combinations, sub-combinations and alternations may occur depending on design requirements and other factors insofar as they are within the scope of the appended claims or the equivalents thereof.

The invention claimed is:

1. An illuminated keyboard comprising:

a key module having a plurality of keycaps, scissors structures, elastic members, and a membrane circuit board;

a keyboard base plate having a plurality of positioning members corresponding to the keycaps and integrally formed on the keyboard base plate for positioning the keyboard module on the keyboard base plate;

a light guiding plate disposed beneath the key module and over the keyboard base plate, the light guiding plate having a light incoming surface, a bottom surface intersecting the light incoming surface, a light outgoing surface opposite to the light incoming surface, and provided with light holes corresponding to the positioning members;

a plurality of light sources arranged on one side of the light incoming surface of the light guiding plate, wherein a light emitted from the light sources is transmitted into the light guiding plate from the light incoming surface and transmitted out of the light guiding plate from the outgoing surface; and a reflecting sheet disposed beneath the bottom surface of the light guiding plate for reflecting the light into the light guiding plate, the reflecting sheet having through holes corresponding to the positioning members and the light holes, wherein the light holes are larger than the through holes, the light transmitted into the light guiding plate effectively illuminates the keyboard module through the light holes, and each of the light holes satisfies the condition $10° \leqq \theta_A \leqq 170°$, where $\theta_A$ is an angle between a side wall inside each of the light holes and the bottom surface of the light guiding plate.

2. The illuminated keyboard of claim 1, wherein the bottom surface of the light guiding plate is provided with a plurality of light condensing patterns for condensing the light emitted from the light source by reflecting and refracting.

3. The illuminated keyboard of claim 2, wherein the light condensing patterns are formed by printing, laminating or sandblasting particles to the bottom surface.

4. The illuminated keyboard of claim 1, wherein the light guiding plate has at a least a side wrapped with reflective material for reflecting the light transmitted out of the light guiding plate, the at leas a side is different from the light incoming surface.

5. The illuminated keyboard of claim 1, wherein the light guiding plate is formed by plastic injection molding.

6. The illuminated keyboard of claim 1, wherein the reflecting sheet is made of white glossy material.

7. The illuminated keyboard of claim 1, wherein each of the light sources can be disposed under the bottom surface of the light guiding plate at a certain distance from the center of the light guiding plate.

8. The illuminated keyboard of claim 1, wherein the keyboard base plate can be a metal mirror surface.

9. The illuminated keyboard of claim 1, wherein the membrane circuit board includes an elastic soft layer and a circuit layer.

10. The illuminated keyboard of claim 1, wherein the membrane circuit board includes a plurality of openings which are corresponding to the positioning members.

11. The illuminated keyboard of claim 10, wherein the positioning members pass through the through holes, the light holes, and the openings of the membrane circuit board so as to connect the reflecting sheet, the light guiding plate and the membrane circuit board.

12. The illuminated keyboard of claim 1, wherein each of the scissors structures is provided between its respective corresponding keycap and respective elastic member, each of the elastic members is provided on the membrane circuit board, each of the scissors structure allows the corresponding keycap to move upward and downward relative to the keyboard base plate, each of the elastic members triggers the membrane circuit board to generate an electric signal when the keycap is pressed.

13. The illuminated keyboard of claim 9, wherein the circuit layer of the membrane circuit board is made of transparent material.

14. The illuminated keyboard of claim 9, wherein the circuit layer of the membrane circuit board can be formed on the top surface of the light guiding plate by printing.

15. The illuminated keyboard of claim 1, wherein the light sources are LEDs.

16. The illuminated keyboard of claim 1, wherein the top surface of the light guiding plate is provided with a plurality of light condensing patterns for condensing the light emitted from the light source by reflecting and refracting.

17. The illuminated keyboard of claim 1, wherein each of the light holes satisfies the condition $45° \leqq \theta_A \leqq 90°$.

* * * * *